United States Patent [19]

Marcade

[11] 3,968,421

[45] July 6, 1976

[54] DELAYED ON QUICK OFF REGULATOR CIRCUIT FOR APPLIANCE CONTROL

[75] Inventor: Roque Denis Marcade, Stevensville, Mich.

[73] Assignee: Whirlpool Corporation, Benton Harbor, Mich.

[22] Filed: Dec. 30, 1974

[21] Appl. No.: 537,076

[52] U.S. Cl. ..... 323/19; 34/55; 317/33 VR; 323/22 T; 323/22 Z

[51] Int. Cl.[2] ..... G05F 3/14; G05F 5/00

[58] Field of Search..... 34/45, 55; 317/31, 33 VR; 321/16, 18; 323/22 T, 22 Z, 38, 16, 19

[56] References Cited

UNITED STATES PATENTS

| | | | |
|---|---|---|---|
| 3,106,645 | 10/1963 | Kaufman | 323/22 T |
| 3,383,580 | 5/1968 | Wallace | 323/22 T |
| 3,409,802 | 11/1968 | Savage | 317/31 |
| 3,445,746 | 5/1969 | Delatorre | 323/22 T |
| 3,522,482 | 8/1970 | Thompson | 323/38 X |
| 3,549,983 | 12/1970 | Sprogis | 323/38 X |
| 3,772,568 | 11/1973 | Phillips | 317/31 X |

*Primary Examiner*—A. D. Pellinen
*Attorney, Agent, or Firm*—Hill, Gross, Simpson, Van Santen, Steadman, Chiara & Simpson

[57] ABSTRACT

An appliance, in particular an automatic clothes drying machine, is provided with a regulated power supply having a storage element and circuit elements for delaying the application of power to an integrated circuit machine control circuit until the storage element is almost completely charged and quickly removing power before the storage element is completely discharged in response to the interruption of power to the regulator circuit.

9 Claims, 3 Drawing Figures

DELAYED ON QUICK OFF REGULATOR CIRCUIT FOR APPLIANCE CONTROL

BACKGROUND OF THE INVENTION

1. Field of the Invention

This invention relates to regulator circuits, and is more particularly concerned with regulator circuits for integrated circuit appliance controls.

2. Description of the Prior Art

Home appliances which automatically operate through a sequence of operational states are generally known in the art and usually require a control circuit for selectively providing the desired cycles or series of machine modes of operation. For example, automatic clothes dryers generally have a number of different cycles or modes of operation, e.g. dry, cool-down, anti-wrinkle and off. Normally the control circuit will require electrical power from a regulated voltage source, and regulation of the voltage source is provided by conventional regulator circuits.

The use of integrated circuits in appliance control has given rise to a problem concerning voltage regulation in that, in some cases the integrated circuit chip may become unstable in response to low voltages and cause improper sequences of operation.

Carl R. Offutt in his U. S. Pat. No. 3,802,091, issued Apr. 9, 1974 and assigned to Whirlpool Corporation, the assignee of the present invention, discloses an integrated circuit dryer control which utilizes a regulator circuit which is interposed between a low voltage source and an integrated circuit for supplying a smooth DC voltage to the integrated circuit. This regulator includes a capacitor connected across the low voltage source and a transistor having its collector-emitter circuit connected in series between the low voltage source and the integrated circuit and its base-emitter circuit, including a Zener diode, connected across the integrated circuit. For this regulator circuit to operate effectively it is also necessary to provide a second, higher (approximately 110 volt) voltage source.

SUMMARY OF THE INVENTION

A primary object of the present invention is to provide an improved regulator circuit which, in addition to providing the normal voltage regulator functions, additionally provides a switching function to totally interrupt low voltage power to the integrated circuit chip of an appliance control circuit whenever the available low voltage source voltage drops below a predetermined reference value, and prevents the application of power to said integrated circuit until said voltage has reached said predetermined reference value.

Another primary object of the present invention is to provide a voltage regulator circuit for regulating the low voltage power supply to the integrated circuit chip of an appliance control which provides a switching function to totally interrupt low voltage power to the chip of an appliance control circuit in response to a source voltage below a predetermined reference value but does not require, for its operation, a secondary higher voltage source.

A regulator constructed in accordance with the present invention is considered to be an improvement over that disclosed in the aforementioned Offutt U.S. Pat. No. 3,802,091. The disclosure of that publication is fully incorporated herein by this reference to show additional circuit connections for fully incorporating the present invention in an automatic dryer control.

According to the invention, a regulator circuit is provided for an appliance which includes a low voltage source and an integrated circuit control (whose I.C. chip is powered by this low voltage source) which governs the sequence of operations of the dryer. The low voltage source includes first and second leads and the integrated circuit chip includes first and second leads for receiving power from the low voltage source. The regulator circuit includes a capacitor which is electrically connected between the first and second leads of the low voltage source and functions as a charge storage element which delays the application of power until the capacitor is charged to an appreciable amount. A first resistor is connected in parallel circuit relationship with the capacitor and a regulator transistor is connected in the circuit so that its collector-emitter circuit is connected in series with the first leads of the voltage source and the integrated circuit chip, its collector-base circuit is connected across the low voltage source leads, and its emitter-base circuit is connected across the leads of the integrated circuit chip. The base-emitter circuit includes a Zener diode and a second diode connected between the Zener diode and the base of the regulator transistor. A switching transistor has its emitter connected to the collector of the regulator transistor and to the first lead of the low voltage source, and its collector and base connected by way of respective resistors to points on either side of the second diode in the base-emitter circuit of the regulator transistor. A third diode is connected in the first lead to the voltage source. When unregulated DC voltage is applied across the first and second leads of the low voltage source, the capacitor begins to charge. The regulator transistor remains off until the capacitor has charged to a point where the Zener voltage of the Zener diode is exceeded. At this point, the switching transistor turns on and causes the regulator transistor to apply regulated voltage to the integrated circuit chip. This delayed turn on sequence advantageously aids in eliminating irregularities in the unregulated supply during start up from being seen by the integrated circuit chip, as would occur, for example, as the result of the contact bounce of a push-to-start relay circuit in a clothes dryer control circuit, and in permitting the capacitor to accumulate the majority of its charge while not being burdened by a current drain of the integrated circuit chip. The improved regulator circuit of the present invention also provides an important safety function in that should the low voltage source not come up to Zener voltage, such as when a diode is shorted in the full wave bridge, the push-to-start relay will not hold in and a potential overheating of the supply transformer will be avoided.

When the source voltage is disconnected or otherwise interrupted while the integrated circuit is under power, the capacitor discharges through the resistors, the diodes, and the integrated circuit chip until the voltage seen by the chip reaches approximately the Zener voltage. The switching transistor then turns off and, in turn, causes the regulator transistor to turn off. The capacitor then continues to discharge through the resistor 96. This sequence provides the advantage that the capacitor potential is reduced where the change in voltage with respect to time is greatest through the aforementioned paths, and that the regulator transistor removes power quickly to enable the integrated circuit chip to reset in anticipation of a reapplication of power so that the appliance can be restarted in a shorter time following an interruption in appliance operation.

Unlike the regulator circuit employed in the dryer control disclosed in the U.S. Pat. No. 3,802,091, the regulator circuit of the present invention does not require a secondary, higher voltage source for its operation.

BRIEF DESCRIPTION OF THE DRAWINGS

Other objects, features and advantages of the invention, its organization, construction and operation will be best understood from the following detailed description taken in conjunction with the accompanying drawings, on which.

DESCRIPTION OF THE PREFERRED EMBODIMENTS

Figure 1:
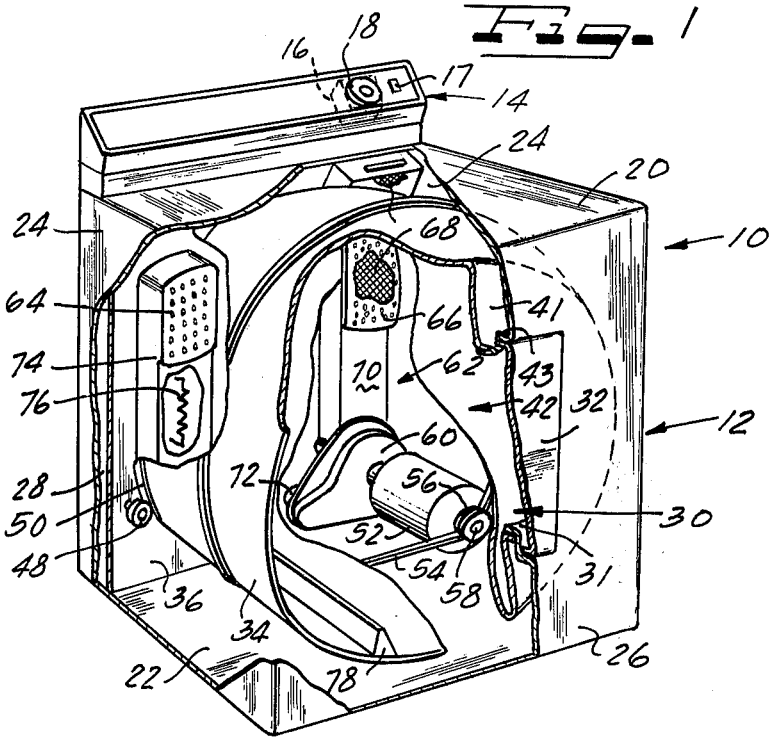
FIG. 1 pictorially illustrates a clothes dryer which may utilize the present invention, the dryer being shown in a partial fragmentary manner.

In the preferred embodiment of the invention, as illustrated in FIG. 1, a clothes drying appliance 10 is shown as comprising an enclosure cabinet 12 with a control console 14 thereon, housing a control device 16 for regulating the drying operation. A control knob 18 selectively sets the control device 16 for various drying cycles of operation, as, for example, automatic or timed drying cycles. The enclosure cabinet 12 comprises a horizontal top panel 20 and a horizontal bottom panel 22, a pair of vertical side panels 24, a vertical front panel 26 and a vertical rear panel 28. An access opening 30 is provided in the front panel 26, as defined by an axially in-turned flange 31, having a closure door 32 cooperating therewith for loading and unloading the dryer 10.

The dryer 10 further includes a drying container for tumbling clothes, in the form of a rotatable drum 34 housed within the cabinet 12 and extending axially from the front panel 26 to a bulkhead 36 spaced forwardly of the rear panel 28. To encourage tumbling action in the clothing being dried, a plurality of circumferentially spaced baffles 78 (only one being illustrated) are mounted on the inner surface of the drum 34. The drum 34 includes a radially inwardly extending front closure wall 41 having an access opening 42 therein formed by means of an axially out-turned flange 43. The flange 43 provides a forwardly extending bearing annulus which overlies and is suitably journaled on the complemental flange 31 of the cabinet 12. It will be apparent from the foregoing that the opening 42 into the drum 34 and the opening 30 formed in the front panel 26 are concentric and provide access into the rotatable drum 34 from outside the cabinet 12. The drum 34 is supported at the rear by a pair of support rollers 48 (only one being illustrated) mounted on the bulkhead 36. A raceway or circumferential groove 50 indented into the peripheral wall of the rear portion of the drum 34 serves as a track for the rollers 48.

A motor 52, mounted to the bottom panel 22 in a rear corner of the cabinet 12, rotatably drives the drum

34 by means of a drive belt 54 extending around the periphery of and in frictional engagement with the drum 34 and around a motor pulley 56 which is mounted at one end of a motor shaft 58. The other end of the motor shaft 58 drives a blower 60, arrange to circulate air through the drum 34. The blower 60 is included in a warm air system 62 positioned between the rear panel 28 and the bulkhead 36.

The bulkhead 36 serves to enclose the open-ended rear portion of the drum 34 and provides a fixed rear wall in which to locate a pair of spaced openings comprising an air inlet 64 and an air outlet 66. The blower 60 draws moisture-laden air from the interior of the drum 34 through the outlet 66, through a removable lint screen 68 and an air duct 70 to the blower 60, and out of the back of the cabinet 12 through an exhaust duct 72. Air exhausted from the drum 34 is replaced by ambient air entering the warm air system 62 by way of an intake opening in the rear panel 28 (not shown) and is drawn through a fresh air duct 74 passing over a heater means 76 and into the drum 34 through the inlet 64. The warm air system 62 thus circulates a stream of warm air through the drum 34, subjecting clothing placed therein to a drying environment to remove moisture from the fabrics while the clothing is tumbled as the drum rotates.

As discussed in detail in the aforementioned offutt patent, the drum also includes a moisture sensor which comprises a pair of electrodes which are bridged by the moist tumbling fabric as the clothing is being dried. One of the sensor electrodes is connected to ground and the other sensor electrode is connected to a moisture sensing circuit of an integrated circuit control (moisture sensing circuit 150, FIG. 3). This moisture sensing circuit is generally of the type described in U.S. Pat. No. 3,702,030, issued Nov. 7, 1972 and assigned to Whirlpool Corporation. Briefly, the moisture sensing circuit operates to provide repetitive pulses to a counter circuit of an integrated circuit. As the moisture content decreases, the frequency of output pulses of the sensing circuit increases. The counter circuit comprises two separate counting chains which are toggled by clock pulses at 60 Hz derived from conventional line current. A first of these counters is repetitively reset at a frequency proportional to the dryness of the clothes by the output pulses of the sensing circuit and is in turn employed each time it overflows to provide a reset pulse for the second counter. Thus when the moisture content of the fabrics reaches a predetermined level the frequency of output pulses from the sensing circuit has increased to the point where the first counting chain is repetitively reset at a sufficient frequency over a long enough period to prevent it from overflowing to reset the second counting chain, thereby allowing the second counting chain to reach its predetermined count. Upon reaching its predetermined count, the second count operates to provide control signals to a control logic circuit which, in conjunction with a drying program stored in a memory, provides output control signals for the dryer. These outputs affect the states of relays 140, 142, and 144 which in turn perform a switching function in the dryer circuit. The most apparent of these control signals include control of heater energization, control of drive motor energization and control of the application of power to the entire dryer control. The control knob 18 in FIG. 1, or push buttons or the like, operate switches which cooperate with the control logic and the memory to select or alter a drying program, and the control device 16 illustrated in FIG. 1 may be considered as including all of the integrated circuit control elements, the clock pulse derivation circuit, etc.

Figure 2:
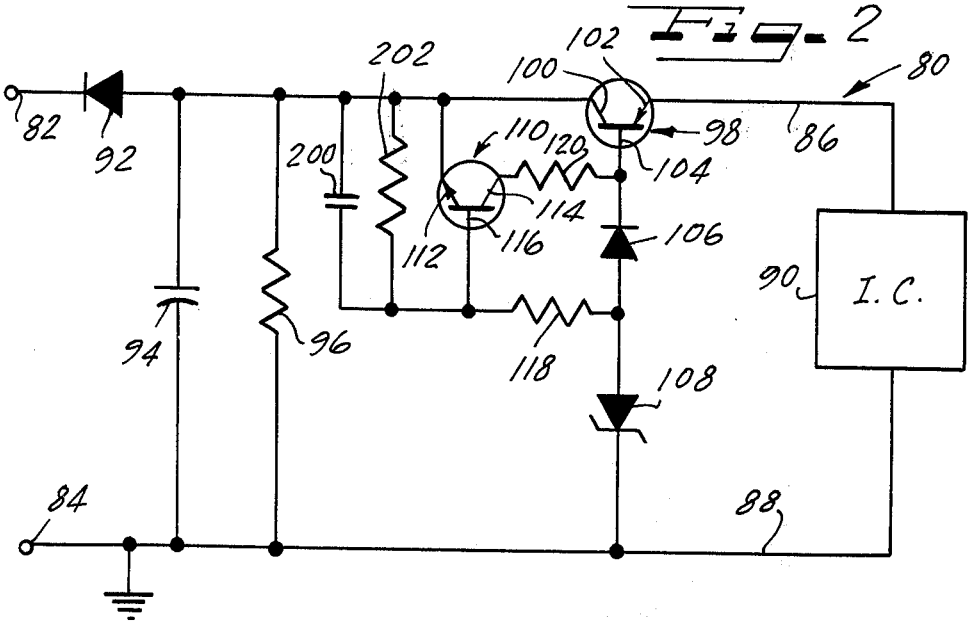
FIG. 2 is a schematic circuit diagram of a regulator circuit constructed in accordance with the present invention.
Figure 3:
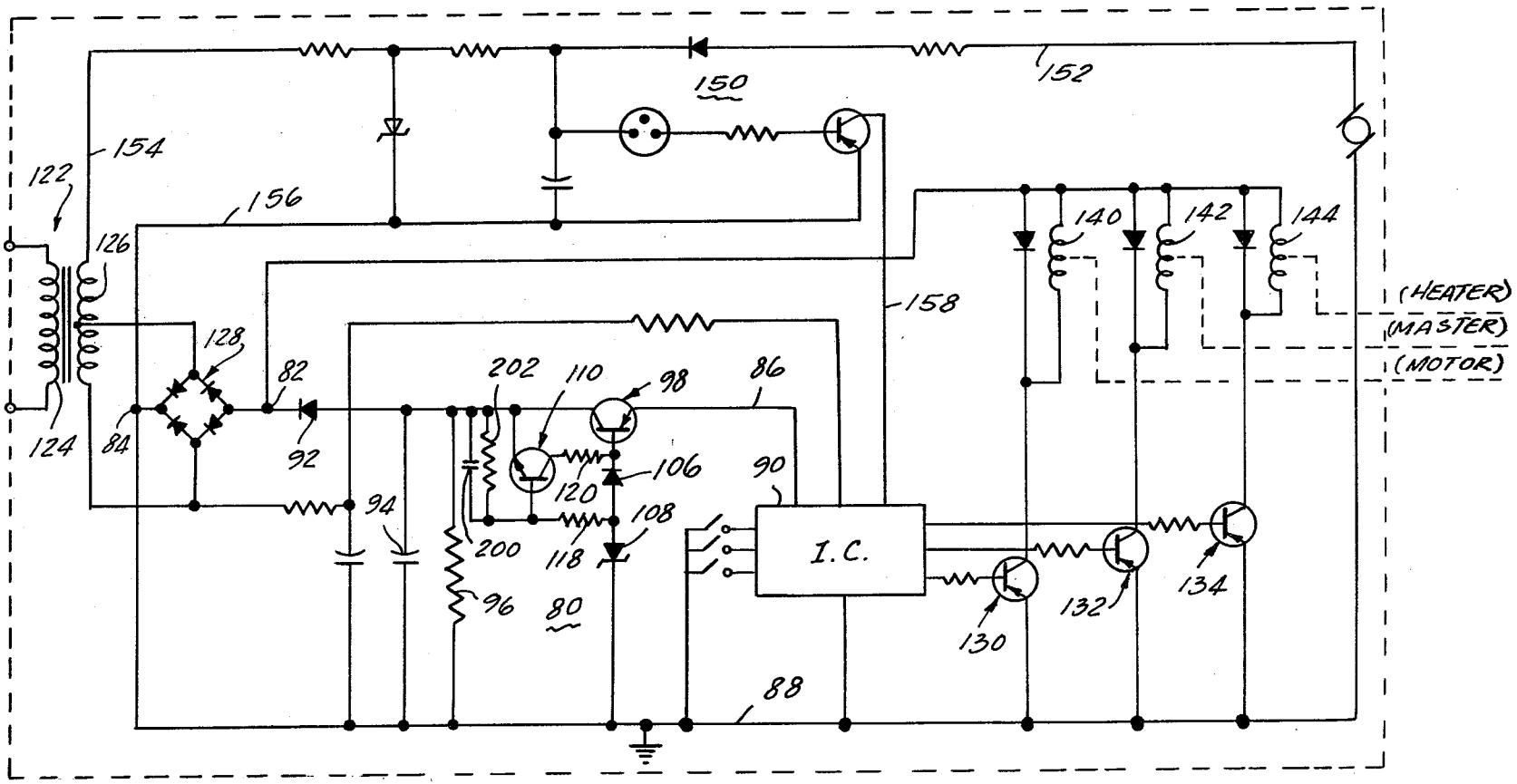
FIG. 3 is a schematic circuit diagram of an integrated circuit control for controlling a dryer, the DC power supply for the integrated circuit, and the regulator circuit of FIG. 2 being connected in circuit with the DC supply and the integrated circuit.

With the foregoing concept of dryer operation and integrated circuit control of such operation in mind, and turning now to FIG. 2, a schematic circuit diagram for a voltage regulator circuit for the integrated circuit of an automatic dryer control is shown. Although not specifically shown in FIG. 2, or in FIG. 3, the dryer is connected as in the aforementioned Offutt patent to a power supply, for example a three-wire 230 volt, 60 Hz A.C. commercial supply. With such a commercial supply, a 230 volt potential is provided for the heater circuit and a 115–120 volt potential is provided for operation of the other components of the dryer control. In FIG. 3 it is to be understood that the 115–120 volt potential at the primary winding 124 of transformer 122 is isolated and transformed to a lower potential source which is available at the secondary winding 126 of transformer 122. This lower potential source is rectified by the full wave rectifier 128 and applied as a voltage source to a pair of leads connected to respective terminals 82 and 84 of a regulator circuit 80. Referring to FIG. 2, it will be seen that the regulator circuit 80 is further connected by a pair of leads 86 and 88 to an integrated circuit chip 90. The regulator circuit includes a diode 92 connected in series with the terminal 82, a capacitor 94 connected, via the diode 92, across the terminals 82 and 84 and a resistor 96 connected in parallel with the capacitor 94.

The regulator circuit further comprises a regulator transistor 98 which includes a collector 100, an emitter 102 and a base 104. The collector 100 is connected to the anode of the diode 92, the emitter 102 is connected to the lead 86 of the integrated circuit chip 90, and the base 104 is connected to the lead 88 and the terminal 84 by way of a diode 106 and a Zener diode 108.

The regulator circuit further comprises switch means including a transistor 110 which includes an emitter 112 connected to the anode of the diode 92 and to the collector 100 of the regulator transistor 98, a collector 114 connected to the base 104 of the regulator transistor 98 and to the cathode of the diode 106 by way of a resistor 120, and a base 116 connected to the anode of the diode 106 and to the anode of the Zener diode 108 by way of a resistor 118.

When power is first applied, or reapplied to the regulator circuit by way of the terminals 82 and 84 and the diode 92, the charge on the capacitor 94 increases. Although the voltage applied to the diode 92, and hence the voltage resulting from the charge on the capacitor 94, may greatly exceed the Zener voltage of the Zener diode 108, the voltage seen by the integrated circuit chip 90 will never exceed the Zener voltage of the Zener diode since all of the additional voltage drop will be taken across the regulator transistor 98. Also, normal dips in the voltage supplied to the terminals 82 and 84 will be compensated by the charge on the capacitor 94.

According to the invention, the switch means comprising the resistor 118, the diode 106 and the transistor 110 are provided, in addition to the more conventional voltage regulator circuitry discussed above, to prevent potentials below a reference level, here the Zener voltage of the Zener diode 108, from being applied to the integrated circuit chip 90. Therefore, as the potential at the anode of the diode 92 increases, the regulator transistor 98 will not be rendered conductive because its base current is blocked by the diode 106 and the switch transistor 110. This condition will prevail and in effect provide an open circuit between the integrated circuit chip and the voltage source, until the supply voltage has charged the capacitor 94 to approximately the Zener voltage of the Zener diode 108. Upon reaching the Zener voltage, the Zener diode 108 will allow current to flow through resistor 118 and into the base 116 of the switch transistor 110 to render the switch transistor 110 conductive. With the switch transistor 110 conductive, the regulator transistor 98 will be turned on and the integrated circuit chip will have a controlled voltage applied thereto which is approximately equal to the Zener voltage of the Zener diode 108.

When the application of voltage to the terminals 82 and 84 is interrupted, the capacitor 94 will discharge gradually through the resistor 96, through the resistors 118 and 120, and through the load provided by the integrated circuit chip 90. When the charge on the capacitor 94 drops below the Zener voltage of the Zener diode 108, the switch transistor 110 turns off and causes the regulator transistor 98 to turn off and remove power from the integrated circuit chip 90.

When the source voltage is interrupted, the drain on the capacitor 94 will be rapid until the reference level (approximately the Zener voltage) is reached and much slower thereafter, due to the nonconductive states of the transistors 98 and 110. Therefore, the integrated circuit chip will be shut down quickly and the slowly decreasing charge on the capacitor 94 will assist in restoring full power to the integrated circuit chip in the event of a reapplication of source voltage to the terminals 82 and 84.

It is to be noted that the improved regulator circuit described herein performs the voltage regulation function in an I.C. controlled appliance, provides a delayed application and immediate removal of nearly constant voltage to the integrated circuit, and assists in a quick reapplication of power to the integrated circuit without the need for any other (secondary) voltage source.

Continuing to refer to FIG. 2, it will be seen that a capacitor 200 and a resistor 202 are each connected across the base to emitter circuit of the transistor 110. The capacitor acts as a filter for high frequency noise which could result, for example, from contact bounce when power is applied to the transformer 122 (see FIG. 3 herein and also FIG. 3 of U.S. Pat. No. 3,802,091) and might otherwise cause the transistor 110 to become momentarily conductive. The resistor 202 provides a discharge path for leakage current coming through the Zener diode 108. Without such a discharge path, leakage current could, in some cases, be sufficient to turn on the transistor 110 before the voltage across the capacitor 94 reached the Zener reference voltage.

Referring to FIG. 3, the circuit of FIG. 2 is illustrated as a part of an integrated circuit control for an automatic dryer. The circuit shown includes the voltage source, the regulator circuit, a moisture sensor circuit, the integrated circuit chip and switching relay circuitry for an automatic clothes dryer. It should be understood, however, that the circuit of FIG. 3 is provided for illustrative purpose only, and that the invention may be advantageously applied equally well to other, different, control circuitry.

In FIG. 3 a transformer 122 includes a primary winding 124 for connection to the 115–120 volt portion of the 230 volt commercial supply, and a secondary winding 126 having one end and a tap thereof connected to a full wave rectifier 128 which is, in turn, connected to the terminals 82 and 84 of the regulator circuit and serves as the unregulated supply. As in FIG. 2, the terminal 84 is connected to ground and to the lead 88 from the integrated circuit chip 90, while the terminal 82 is connected to the lead 86 of the integrated circuit chip 90 by way of the diode 92 and the collector-emitter circuit of the regulator transistor 98.

The full wave rectifier 128 is also connected, via the terminals 82 and 84 to a plurality of relay driver output circuits 130, 132 and 134 which are controlled by the integrated circuit chip 90, as in the aforementioned Offutt patent, to energize respective relays 140, 142 and 144.

The moisture sensing circuit 150 is connected to the secondary winding 126 of the transformer 122 by way of a conductor 154 and to ground by way of a conductor 156, and to the integrated circuit chip 90 by way of a conductor 158 as in the Offutt patent, and receives input signals from the ungrounded sensor electrode, as previously discussed, by way of the conductor 152.

Inasmuch as a detailed discussion of the operation of the moisture sensing circuit 150 and the relay driver circuits 130–134 are fully discussed in the incorporated reference, a detailed discussion is not necessary at this point; however, FIG. 3 has been provided to more clearly illustrate the environment of a regulator circuit constructed according to the invention. Briefly, the sensor circuit 150 senses the dryness condition of articles contained in the dryer drum 34 and, in response to the sensed condition, provides signals by way of the conductor 158 to the integrated circuit chip 90. The integrated circuit chip 90 contains the heart of the control circuit and includes logic circuitry, memory circuitry, and miscellaneous additional circuitry for interpreting signals received from the sensor circuit (and from program selection switches) and in response thereto provides output signals to the circuits 130–134 to control dryer functions by way of the relays 140–144.

Power for the control circuit is received, as shown, from the commercial supply by way of the transformer 122 and the full wave rectifier 128, with the regulator circuit interfacing between the integrated circuit chip and the voltage source to provide the voltage regulation functions described in detail above. As an example of a practical embodiment of the invention disclosed herein for providing −27 volts regulated DC to the integrated circuit chip 90 from a −30 volts unregulated DC applied to the terminals 82, 84, the following tabulation of component values is given.

| COMPONENT | VALUE (Designation) |
|---|---|
| 94 | 60 mfd |
| 96 | 27 K ohm |
| 120 | 6.8 K ohm |
| 118 | 15 K ohm |
| 92, 106 | 1 N 4003 |
| 108 | 1 N 4750 (27V) |
| 98 | TP 30 (Texas Instruments) |
| 110 | MPS 6531 (Motorola) |
| 200 | .002 mfd |
| 202 | 27 K ohm |

Although I have described my invention by reference to a particular illustrative embodiment thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

Having described the invention, the embodiments of the invention in which an exclusive property or privilege is claimed are defined as follows:

1. In a regulator circuit of an appliance, which regulator circuit is connected between a voltage source and an integrated control circuit powered by the voltage source, and which includes a regulator transistor having its collector-emitter circuit connected in series with the voltage source and the integrated control circuit, and its base-emitter circuit, including a Zener diode, connected across the integrated control circuit, the improvement therein comprising:

switch means, including a switch transistor having a base-emitter circuit connected in series with said Zener diode across the voltage source and a collector-emitter circuit connected across the collector-base circuit of the regulator transistor, for preventing application of potentials to the integrated control circuit which are below a predetermined level.

2. The appliance as claimed in claim 1 wherein said switch means includes means for providing a discharge path for leakage current present in said regulator circuit means, whereby functioning of said switch means is not impaired by the presence of said leakage current.

3. The appliance as claimed in claim 1 wherein said switch means includes filter means for filtering high frequency noise present in said regulator circuit means, whereby functioning of said switch means is not impaired by the presence of said high frequency noise.

4. In an appliance having a voltage source including first and second leads and an integrated circuit control including first and second leads connected to receive power from the voltage source, circuit means electrically connected between said voltage source and said integrated circuit control, said circuit means comprising:

a capacitor electrically connected between said first and second leads of said voltage source;

a first resistor electrically connected between said first and second leads of said voltage source;

a Zener diode having an anode and a cathode, said cathode electrically connected to said first lead of said voltage source and to said first lead of said integrated circuit control;

a diode having an anode and a cathode, said anode of said diode electrically connected to said anode of said Zener diode;

a first transistor including a base, a collector, and an emitter, said emitter electrically connected to the second lead of said integrated circuit control, said collector electrically connected to the second lead of said voltage source, and said base electrically connected to said cathode of said diode;

a second transistor including a base, a collector, and an emitter, said emitter electrically connected to the second lead of said voltage source;

a second resistor electrically connected between said cathode of said diode and said collector of said second transistor; and a third resistor electrically connected between said anode of said diode and said base of said second transistor;

said second transistor conductive only in response to a potential received from the voltage source above the Zener voltage of said Zener diode and said first transistor conductive only in response to conduction of said second transistor;

said capacitor charged in response to voltage applied from the voltage source and discharged via said first resistor when both said first and second transistors are non-conductive.

5. The circuit means as claimed in claim 4, comprising a fourth resistor electrically connected across the emitter to base circuit of said second transistor for providing a discharge path for leakage current present in said circuit means.

6. The circuit means as claimed in claim 4 wherein said circuit means includes a second capacitor connected across the emitter to base circuit of said second transistor for filtering high frequency noise present in said circuit means.

7. In a clothes dryer having a low voltage source of electrical power including first and second output leads and an integrated circuit chip for controlling operation of the dryer including first and second input leads; circuit means electronically connected between said voltage source and said chip for providing regulated power to said chip, said circuit means comprising:

a regulator circuit including a capacitor electrically connected between said first and second leads of said voltage source, a first resistor connected across said capacitor, a Zener diode having a anode and a cathode, said cathode electrically connected to said first lead of said voltage source and to said first lead of said chip, a first transistor including a base, a collector, and an emitter, said emitter of said first transistor electrically connected to said second lead of said chip, and said collector electrically connected to the second lead of said voltage source, and a second resistor including first and second leads, said first lead of said second resistor electrically connected to said base of said first transistor; and a switch circuit including a diode including an anode and a cathode, said cathode of said diode electrically connected to said base of said first transistor and said first lead of said second resistor, said anode of said diode electrically connected to said anode of said Zener diode, a third resistor including first and second leads, said first lead of said electrically connected to said anode of said diode and to said anode of said Zener diode, and a second transistor including a base, a collector, and an emitter, said emitter of said second transistor electrically connected to said second lead of said voltage source and to said collector of said first transistor, said collector of said second transistor electrically connected to said second lead of said second resistor, said base of said second transistor electrically connected to said second lead of said third resistor, whereby said switch circuit holds said first transistor of said regulator circuit non-conductive in response to voltage applied from said voltage source below a reference level to thereby effectively interrupt electrical power to said chip.

8. Circuit means for a clothes dryer as claimed in claim 7 wherein said switch circuit includes a fourth resistor electrically connected across the emitter to base circuit of said second transistor for providing a discharge path for leakage current present in said circuit means.

9. Circuit means for a clothes dryer as claimed in claim 7 wherein said switch circuit includes a second capacitor connected across the emitter to base circuit of said second transistor for filtering high frequency noise present in said circuit means.

* * * * *